US010738490B2

(12) United States Patent
Itagaki

(10) Patent No.: US 10,738,490 B2
(45) Date of Patent: Aug. 11, 2020

(54) BINDING MACHINE

(71) Applicant: MAX CO., LTD., Chuo-ku, Tokyo (JP)

(72) Inventor: Osamu Itagaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 206 days.

(21) Appl. No.: 15/847,663

(22) Filed: Dec. 19, 2017

(65) Prior Publication Data

US 2018/0187433 A1 Jul. 5, 2018

(30) Foreign Application Priority Data

Dec. 29, 2016 (JP) ..... 2016-257448

(51) Int. Cl.
*E04G 21/12* (2006.01)
*B21F 15/04* (2006.01)
*B21F 23/00* (2006.01)

(52) U.S. Cl.
CPC ..... *E04G 21/123* (2013.01); *B21F 15/04* (2013.01); *B21F 23/00* (2013.01)

(58) Field of Classification Search
CPC .. B21F 9/02; B21F 15/00; B21F 15/02; B21F 15/04; B21F 23/00; B21F 23/005; B21F 33/00; B65B 13/025; B65B 13/027; B65B 13/28; B65B 13/285; B65B 13/22; B65H 59/04; E04G 21/122; E04G 21/123
See application file for complete search history.

(56) References Cited

U.S. PATENT DOCUMENTS 5,944,064 A 8/1999 Saito et al.
2006/0011254 A1 1/2006 Yokochi et al.

FOREIGN PATENT DOCUMENTS

EP 0 249 737 A2 12/1987
JP 11-156748 A 6/1999
JP 2004-142813 A 5/2004
JP 2012101860 A * 5/2012

OTHER PUBLICATIONS

EPO Machine Translation of JP-2012101860-A (Year: 2019).*
Extended European Search Report dated Feb. 7, 2018 in corresponding EP Patent Application No. 17208826.2 (7 pages).

* cited by examiner

*Primary Examiner* — Pradeep C Battula
(74) *Attorney, Agent, or Firm* — Rothwell, Figg, Ernst & Manbeck, P.C.

(57) ABSTRACT

A binding machine includes a wire feeding unit which feeds a wire, a curl guide which curls the fed wire around an object to be bound, a binding unit including a twisting shaft provided to be rotatable around an axis, a gripping part provided at one end of the twisting shaft and a drive unit provided to the other end of the twisting shaft, a control unit which controls the drive unit, and a binding machine main body which accommodates therein the binding unit and the control unit. When an inside of the binding machine main body is divided by a virtual plane perpendicular to the axis to be partitioned into a first space in which the gripping part is accommodated and a second space in which the drive unit is accommodated, the control unit is arranged in the second space in which the drive unit is accommodated.

14 Claims, 4 Drawing Sheets

BINDING MACHINE

CROSS-REFERENCE TO RELATED APPLICATION

This application claims the priority from Japanese Patent Application No. 2016-257448 filed on Dec. 29, 2016, the entire contents of which are incorporated herein by reference.

FIELD

The present disclosure relates to a binding machine.

BACKGROUND

In the related art, a reinforcing bar binding machine has been widely used which includes a wire feeding unit configured to feed a wire, a curl guide unit configured to bend the wire fed by the wire feeding unit into a loop shape and to curl (wind) the wire around reinforcing bars, and a binding unit configured to bind the reinforcing bars by gripping and twisting the wire wound around the reinforcing bars at the curl guide unit. Also, a reinforcing bar binding machine configured to use two or more wires has been developed. The operations of the wire feeding unit and the binding unit are controlled by a calculation unit such as a CPU mounted on a control board. The wire feeding unit, the binding unit, the control board and the like are accommodated in a binding machine main body (housing), and a handle part provided for an operator to grip the same for a binding operation extends from the binding machine main body. In the meantime, the binding unit includes a twisting mechanism configured to grip and twist the wire and a twisting motor configured to drive the twisting mechanism.

In general, the control board may be arranged in the binding machine main body and between the handle part and the twisting mechanism. JP-A-2004-142813 discloses a reinforcing bar binding machine including a control board configured to supply power to a feeding motor of a wire feeding unit and a twisting motor, wherein the control board is arranged to extend between a twisting mechanism and the twisting motor.

However, the reinforcing bar binding machine disclosed in JP-A-2004-142813 and the like has following problems. Generally, in the reinforcing bar binding machine, iron powders and chips of the wire, which are generated during the binding operation, may be introduced from a gap between the twisting mechanism under translation and rotation and the binding machine main body. For this reason, in the arrangement of the control board of the reinforcing bar binding machine, the iron powders and chips introduced into the binding machine main body may be attached to a connector terminal portion and the like mounted on the control board.

The present disclosure has been made in view of the above situations, and an object thereof is to provide a binding machine capable of preventing iron powders and chips of a wire introduced into a binding machine main body from being attached to a control unit in the binding machine main body.

A binding machine of the present disclosure includes a wire feeding unit configured to feed a wire, a curl guide unit configured to curl the wire fed by the wire feeding unit around an object to be bound, a binding unit including a twisting shaft provided to be rotatable around a predetermined axis, a gripping part provided at one end side of the twisting shaft and a drive unit provided to the other end side of the twisting shaft, wherein the gripping part is configured to grip the wire curled by the curl guide unit and the twisting shaft is configured to twist the gripped wire so as to bind the object, a control unit configured to control an operation of the drive unit, and a binding machine main body configured to accommodate therein the binding unit and the control unit, wherein when an inside of the binding machine main body is divided into two by a virtual plane perpendicular to or substantially perpendicular to the axis so as to be partitioned into a first space in which the gripping part is accommodated and a second space in which the drive unit is accommodated, the control unit is arranged in the second space in which the drive unit is accommodated.

In the binding machine, the curl guide unit may include a first guide part configured to receive the wire from the wire feeding unit, and a second guide part configured to receive the wire from the first guide part. The first guide part is provided at a position facing the second guide part with the axis being interposed therebetween. When a space in the binding machine main body which is provided with the first guide part and is located above the axis is set as an upper space and a space which is provided with the second guide part and is located below the axis is set as a lower space, the control unit may be arranged in the upper space.

The binding machine may further include a handle part extending from the binding machine main body in a direction intersecting with the axis, and the control unit may be arranged at a position facing the handle part with the binding unit being interposed therebetween in the binding machine main body.

In the binding machine, the binding machine main body may include a partition part configured to partition the first space and the second space.

In the binding machine, the twisting shaft may be accommodated in the first space.

In the binding machine, the control unit may include a control board, and the control board may be arranged such that a component surface thereof faces the drive unit.

According to the present disclosure, when the inside of the binding machine main body is divided in to two by the virtual plane a virtual plane perpendicular to or substantially perpendicular to the axis so as to be partitioned into the first space in which the gripping part is accommodated and the second space in which the drive unit is accommodated, the control unit is arranged in the second space in which the drive unit is accommodated. Therefore, it is possible to prevent iron powders and chips of the wire, which are generated at the gripping part-side, from being attached to the control unit.

DETAILED DESCRIPTION

Hereinafter, embodiments of the present disclosure will be described in detail with reference to the accompanying drawings.

[Example of Sectional Configuration of Reinforcing Bar Binding Machine 1A]

Figure 1:
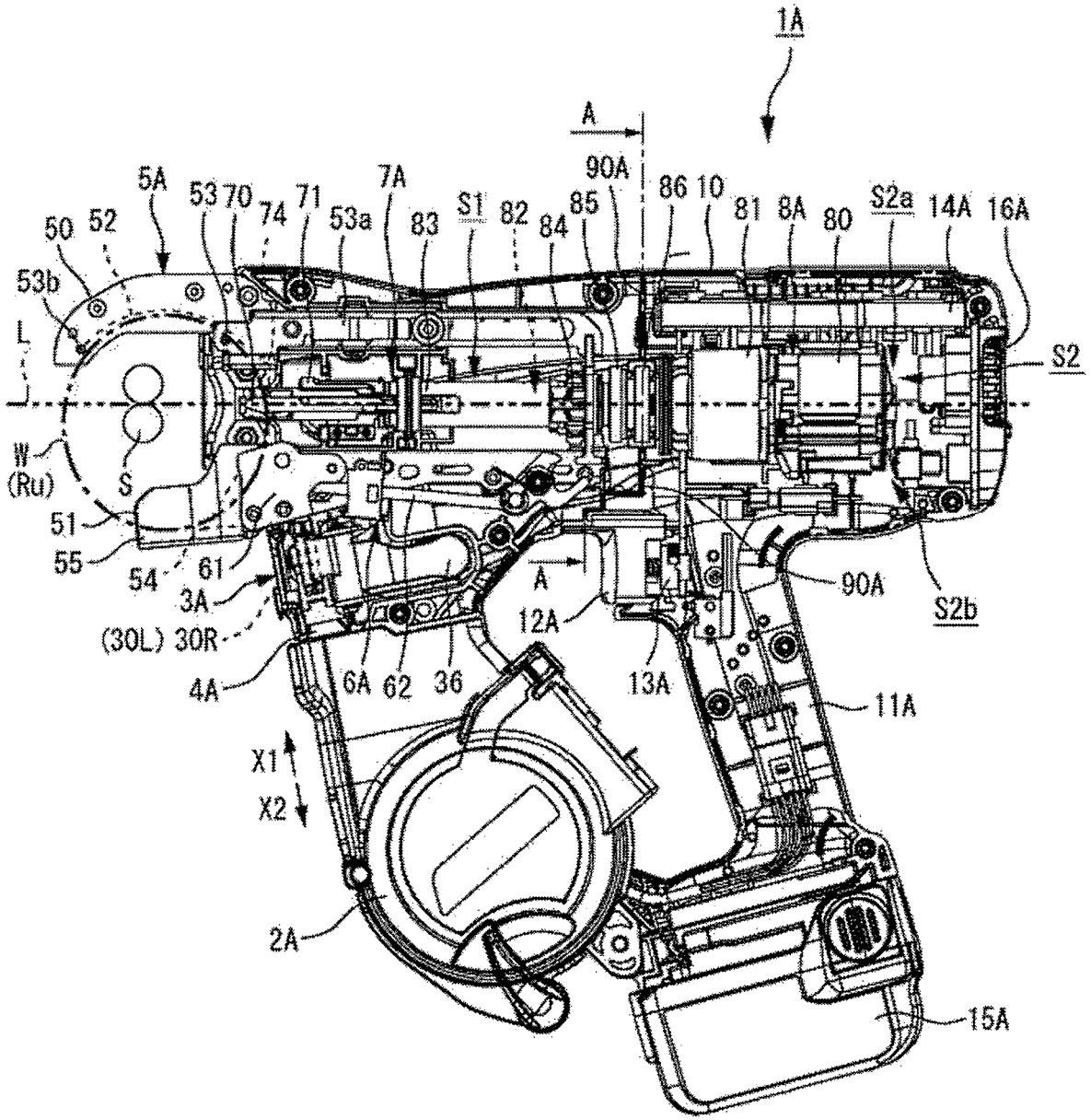
FIG. 1 is a view depicting an example of a section in a front and back direction of a reinforcing bar binding machine according to an embodiment of the present disclosure.

FIG. 1 is a view depicting an example of a section of a reinforcing bar binding machine 1A according to an embodiment of the present disclosure. In the reinforcing bar binding machine 1A of FIG. 1, a left side of the drawing sheet is referred to as a front side of the reinforcing bar binding machine 1A, a right side of the drawing sheet is referred to as a rear side of the reinforcing bar binding machine 1A, an upper side of the drawing sheet is referred to as an upper side of the reinforcing bar binding machine 1A, and a lower side of the drawing sheet is referred to as a lower side of the reinforcing bar binding machine 1A.

As shown in FIG. 1, the reinforcing bar binding machine 1A includes a binding machine main body 10, a handle part 11A, a magazine 2A, which is an accommodation unit configured to accommodate therein a wire W, a wire feeding unit 3A configured to feed the wire W accommodated in the magazine 2A, and a guide unit 4A configured to guide the wire W to be fed into the wire feeding unit 3A and the wire W to be fed from the wire feeding unit 3A. Further, the reinforcing bar binding machine 1A includes a curl guide unit 5A configured to wind the wire W to be fed from the wire feeding unit 3A around reinforcing bars S, and a cutting unit 6A configured to cut the wire W wound around the reinforcing bars S. Further, the reinforcing bar binding machine 1A includes a twisting mechanism 7A configured to grip and twist the wire W wound around the reinforcing bars S. The curl guide unit 5A is provided to protrude from one end (tip end) side of the binding machine main body 10.

The binding machine main body 10 is configured by a case having an elongated tubular shape extending in a front and back direction (a front and back direction when a side (one end side) to which the curl guide unit 5A is provided is referred to as a forward direction and an opposite side (the other end side) thereto is referred to as a back direction). In the binding machine main body 10, the twisting mechanism 7A, a drive mechanism 8A configured to drive the twisting mechanism 7A, and the like are mounted to predetermined positions. The configuration of the binding machine main body 10 will be described in detail later.

The handle part 11A is configured to be gripped by an operator and extends from a lower surface of a slightly rear side of a center portion of the binding machine main body 10 toward a direction perpendicular to or substantially perpendicular to an axis L. The axis L is a virtual line extending in an axial direction (the front and back direction in the binding machine main body 10) of a rotary shaft 82 (refer to FIG. 4) provided in the binding machine main body 10. A trigger 12A with which the operator operates the reinforcing bar binding machine 1A is provided in the vicinity of a boundary between the handle part 11A and the binding machine main body 10 at a front side part of the handle part 11A. It is noted that the handle part 11A may extend in a direction which is not perpendicular to the rotary shaft 82 as long as the handle part 11A extends in a direction intersecting with the rotary shaft 82.

A switch 13A is provided in the handle part 11A at the rear of the trigger 12A. The switch 13A is configured to be turned on and to operate a twisting motor 80 and the like in accordance with an operator's pressing operation on the trigger 12A. A battery 15A is detachably mounted to a lower part of the handle part 11A.

In the magazine 2A, a reel 20 on which the long wire W is wound to be reeled out is detachably accommodated. In the reinforcing bar binding machine 1A, while the reel 20 accommodated in the magazine 2A is rotated, the wire W is reeled out from the reel 20 during an operation of feeding the wire W with the wire feeding unit 3A and during an operation of manually feeding the wire W.

The wire feeding unit 3A includes, as a pair of feeding members configured to feed the wires W, a first feeding gear 30L having a spur gear shape and configured to feed the wire W by a rotating operation, and a second feeding gear 30R having a spur gear shape and configured to sandwich the wires W between the first feeding gear 30L and the second feeding gear 30R. The first feeding gear 30L and the second feeding gear 30R have a spur gear shape having a tooth part formed on an outer peripheral surface of a circular plate-shaped member, respectively. Meanwhile, in FIG. 1, the first feeding gear 30L is located at a back side of the first feeding gear 30R with respect to the drawing sheet.

The wire feeding unit 3A is configured such that the first feeding gear 30L and the second feeding gear 30R are provided with a feeding path of the wires W being interposed therebetween and thus the outer peripheral surfaces of the first feeding gear 30L and the second feeding gear 30R face each other. The first feeding gear 30L and the second feeding gear 30R are configured to sandwich the wire W between the facing portions of the outer peripheral surfaces. The first feeding gear 30L and the second feeding gear 30R are configured to feed the wire W along the extension direction of the wire W.

The wire feeding unit 3A is configured such that the rotation directions of the first feeding gear 30L and the second feeding gear 30R are switched and the feeding direction of the wire W is switched between the forward and reverse directions by switching a rotation direction of a feeding motor (not shown) between the forward and reverse directions.

In the reinforcing bar binding machine 1A, the first feeding gear 30L and the second feeding gear 30R are rotated in the forward direction with the wire feeding unit 3A such that the wire W is fed in a forward direction denoted with an arrow X1, i.e., toward the curl guide unit 5A and is then wound around the reinforcing bars S with the curl guide unit 5A. After winding the wire W around the reinforcing bars S, the first feeding gear 30L and the second feeding gear 30R are rotated in the reverse direction, so that the wire W is fed (pulled back) in a reverse direction denoted with an arrow X2, i.e., toward the magazine 2A. The wire W is wound around the reinforcing bars S and is then pulled back such that the wire W is closely contacted to the reinforcing bars S.

The wire feeding unit 3A includes a second displacement member 36 provided between the first feeding gear 30L and second feeding gear 30R, and the handle part 11A. The wire feeding unit 3A is configured to displace the first feeding gear 30L and the second feeding gear 30R in directions of coming close to and separating from each other. An operation button (not shown) configured to displace the second displacement member 36 is attached to the second displacement member 36.

The guide unit 4A is provided between the magazine 2A, and the first feeding gear 30L and second feeding gear 30R. The guide unit 4A is configured to regulate a direction of one or more fed wires W (while aligning the wires W in parallel when a plurality of wires W is fed) and to deliver the wire W. The guide unit 4A may be provided downstream of the first feeding gear 30L and the second feeding gear 30R with respect to the arrow X1 direction.

The curl guide unit 5A includes a first guide part 50 configured to curl the wire W to be fed by the first feeding gear 30L and the second feeding gear 30R, and a second guide part 51 configured to guide the wires W fed from the first guide part 50 toward the twisting mechanism 7A. The first guide part 50 is provided at a position facing the second guide part 51 with the axis L being interposed therebetween.

The first guide part 50 has a guide groove 52 configuring a feeding path of the wire W and guide pins 53, 53*b* as a guide member configured to curl the wire W in cooperation with the guide groove 52.

The guide groove 52 is configured to regulate a direction of the wire W in a radial direction perpendicular to the feeding direction of the wire W together with the guide unit 4A.

The guide pin 53 is provided at an introduction part-side of the first guide part 50, to which the wire W being fed by the first feeding gear 30L and the second feeding gear 30R are introduced. The guide pin 53 is arranged at a radially inner side of a loop Ru to be formed by the wire W with respect to the feeding path of the wire W configured by the guide groove 52. The guide pin 53 is configured to regulate the feeding path of the wire W such that the wire W being fed along the guide groove 52 do not enter the radially inner side of the loop Ru to be formed by the wire W.

The guide pin 53*b* is provided at a discharge part-side of the first guide part 50, from which the wire W being fed by the first feeding gear 30L and the second feeding gear 30R is discharged, and is arranged at a radially outer side of the loop Ru to be formed by the wire W with respect to the feeding path of the wire W configured by the guide groove 52.

The wire W that is fed by the first feeding gear 30L and the second feeding gear 30R is curled as a radial position of the loop Ru to be formed by the wire W is regulated at least at three points of two points of the radially outer side of the loop Ru formed by the wire W and one point of the radially inner side between the two points.

In this example, a radially outer position of the loop Ru to be formed by the wire W is regulated at two points of the guide unit 4A provided upstream of the guide pin 53 and the guide pin 53*b* provided downstream of the guide pin 53 with respect to the feeding direction of the wire W that is fed in the forward direction. A radially inner position of the loop Ru to be formed by the wire W is regulated by the guide pin 53.

The curl guide unit 5A includes a retraction mechanism 53*a* configured to retract the guide pin 53 from a moving path of the wire W during an operation of winding the wire W on the reinforcing bars S. The retraction mechanism 53*a* is configured to be displaced in conjunction with the operation of the twisting mechanism 7A after the wire W is wound around the reinforcing bars S and to retract the guide pin 53 from the moving path of the wire W before the wire W is wound on the reinforcing bars S.

The second guide part 51 has a fixed guide part 54 configured to regulate a radial position (movement of the wire W in the radial direction of the loop Ru) of the loop Ru to be formed by the wire W to be wound around the reinforcing bars S and a moveable guide part 55 configured to regulate a position (movement of the wire W in an axial direction Ru1 of the loop Ru) along the axial direction Ru1 of the loop Ru to be formed by the wire W to be wound around the reinforcing bars S.

The moveable guide part 55 is opened and closed between a guide position at which it can guide the wire delivered from the first guide part 50 toward the second guide part 51 and a retraction position at which it is retracted during an operation of pulling out the reinforcing bar binding machine 1A from the reinforcing bars S by a rotating operation about a shaft, which is a support point.

The cutting unit 6A includes a fixed blade part (not shown), a rotary blade part 61 configured to cut the wire W in cooperation with the fixed blade part, and a transmission mechanism 62 configured to transmit an operation of the twisting mechanism 7A to the rotary blade part 61. The rotary blade part 61 is configured to cut the wire W, which is to pass through the guide unit 4A of the fixed blade part, by a rotating operation about a shaft, which is a support point. The transmission mechanism 62 is configured to be displaced in conjunction with the operation of the twisting mechanism 7A and to rotate the rotary blade part 61 in conformity to timing at which the wire W is to be twisted after the wire W is wound on the reinforcing bars S, thereby cutting the wires W.

The twisting mechanism 7A includes a gripping part 70 configured to grip the wire W, a bending part (bending portion) 71 configured to bend one end portion WS and the other end portion WE of the wire W toward the reinforcing bars S, a length regulation part 74 configured to regulate a position of one end portion WS of the wire W, a twisting motor 80, a rotary shaft (twisting shaft) 82 configured to be driven by the twisting motor 80 via a decelerator 81 for deceleration and torque amplification, a moveable member 83 configured to be displaced by a rotating operation of the rotary shaft 82, and a rotation regulation member 84 configured to regulate rotation of the moveable member 83 coupled to the rotating operation of the rotary shaft 82.

The rotary shaft 82 is provided to be rotatable around the axis L. The rotary shaft 82 is provided at one end side with the gripping part 70 and at the other end side with the twisting motor 80. The twisting mechanism 7A is configured to grip the wire W curled with the curl guide unit 5A by the gripping part 70, and to bind the reinforcing bars S by twisting the gripped wire W with the rotary shaft 82. In the below, the twisting motor 80 and the decelerator 81 may also be collectively referred to as the drive mechanism 8A.

The gripping part 70 includes a fixed gripping member 70C, a first moveable gripping member 70L, and a second moveable gripping member 70R (refer to FIG. 3). The first moveable gripping member 70L and the second moveable gripping member 70R are arranged at left and right sides with the fixed gripping member 70C being interposed therebetween. Specifically, the first moveable gripping member 70L is arranged at one side along the axial direction of the wire W to be wound and the second moveable gripping member 70R is arranged at the other side, with respect to the fixed gripping member 70C.

The bending part 71 is configured to bend the wire W such that the end portion of the wire W bound on the object to be bound are located closer to the object to be bound than the top of the wire W most protruding in a direction of getting away from the object to be bound. The bending part 71 is configured to bend the wire W gripped with the gripping part 70, before twisting the wire W by the gripping part 70.

The length regulation part 74 includes a member, to which the one end portion WS of the wire W is to be butted, on the feeding path of the wire W having passed between the fixed gripping member 70C and the first moveable gripping member 70L. In this example, the length regulation part 74 is provided to the first guide part 50 of the curl guide unit 5A so as to secure a predetermined distance from a gripping position of the wire W by the fixed gripping member 70C and the first moveable gripping member 70L.

The rotary shaft 82 and the moveable member 83 are configured such that the rotating operation of the rotary shaft 82 is converted into movement in a front and back direction along the rotary shaft 82 of the moveable member 83 by a screw part provided to the rotary shaft 82 and a nut part provided to the moveable member 83. The twisting mechanism 7A is provided integrally with the moveable member 83, so that the movement of the moveable member 83 in the front and back direction causes the twisting mechanism 7A to move in the front and back direction.

In an operation area in which the wire W is gripped by the gripping part 70 and the wire W are bent by the bending part 71, the moveable member 83 and the bending part 71 are engaged with the rotation regulation member 84, and are thus moved in the front and back direction with the rotating operation being regulated by the rotation regulation member 84. Also, when the moveable member 83 and the bending part 71 are disengaged from the rotation regulation member 84, they are rotated by the rotating operation of the rotary shaft 82.

Figure 2:
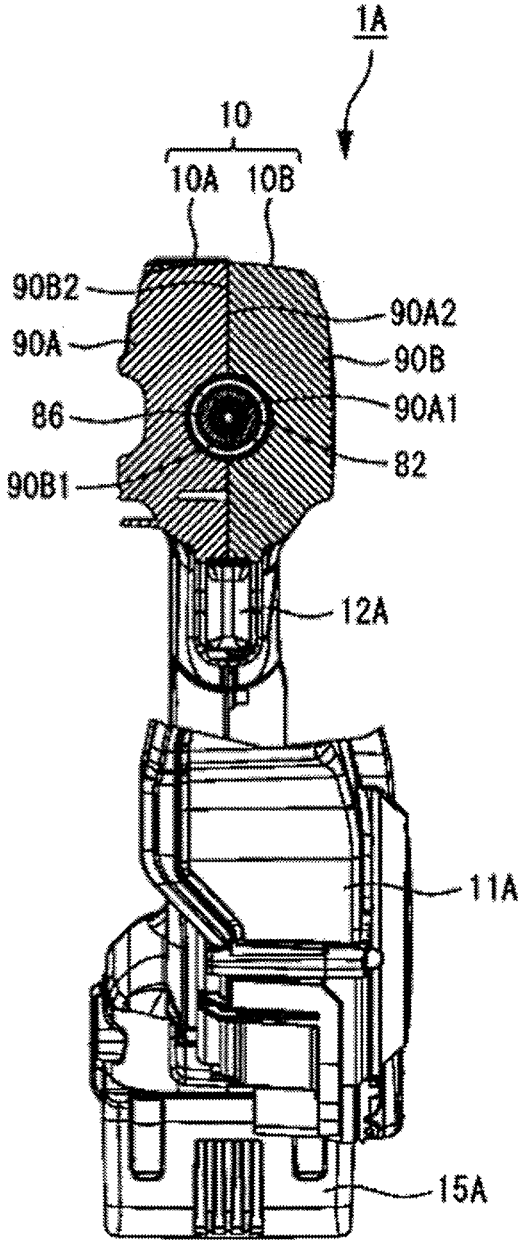
FIG. 2 is a view depicting an example of a section in a right and left direction of the reinforcing bar binding machine.

FIG. 2 depicts an example of the configuration of the binding machine main body 10 and is a sectional view taken along a line A-A of the reinforcing bar binding machine 1A shown in FIG. 1. In the reinforcing bar binding machine 1A of FIG. 2, a left side of the drawing sheet is referred to as a left side of the reinforcing bar binding machine 1A, and a right side of the drawing sheet is referred to as a right side of the reinforcing bar binding machine 1A.

As shown in FIGS. 1 and 2, the case configuring the binding machine main body 10 includes a left case 10A and a right case 10B, and has a halved structure that can be divided at right and left sides of the reinforcing bar binding machine 1A. An inside of the binding machine main body 10 is divided into two by a virtual plane (a plane formed by ribs 90A, 90B, which will be described later) perpendicular to or substantially perpendicular to the axis L and is thus partitioned into a front space (an example of a first space) Si in which the gripping part 70 and the rotary shaft 82 are accommodated and a rear space (an example of a second space) S2 in which the drive mechanism 8A is accommodated. In the embodiment, the binding machine main body 10 is divided by a flat plate member corresponding to the virtual plane.

The left case 10A s provided with a rib (partition part) 90A for partitioning the front space S1 in which the gripping part 70 is arranged and the rear space S2 in which the drive mechanism 8A is arranged. The rib 90A is configured by a flat plate member having a substantially semi-elliptical shape and is provided to stand on an inner surface of the left case 10A such that a planar direction thereof is perpendicular to the rotary shaft 82 of the twisting mechanism 7A. The rib 90A is continuously formed between an upper end edge of the left case 10A and a lower end edge of the left case 10A, which is an upper position of the trigger 12A. A center portion of a right end of the flat plate member configuring the rib 90A is formed with a concave portion 90A1 for fitting therein a support member 86 provided between a bumper 85 and the decelerator 81. In this embodiment, the rib 90A is formed integrally with the inner surface of the left case 10A. However, the rib 90A may also be configured by a separate member from the left case 10A. Further, the rib 90A may not be perpendicular to the rotary shaft 82.

Similarly, the right case 10B is formed with a rib (partition part) 90B for partitioning the front space S1 in which the gripping part 70 is arranged and the rear space S2 in which the drive mechanism 8A is arranged. The rib 90B is configured by a flat plate member having a substantially semi-elliptical shape and is provided to stand on an inner surface of the right case 10B such that a planar direction thereof is perpendicular to the rotary shaft 82 of the twisting mechanism 7A. The rib 90B is continuously formed between an upper end edge of the right case 10B and a lower end edge of the right case 10B, which is an upper position of the trigger 12A. A center portion of a left end of the flat plate member configuring the rib 90B is formed with a concave portion 90B1 for fitting therein the support member 86 provided between the bumper 85 and the decelerator 81. In this embodiment, the rib 90B is formed integrally with the inner surface of the right case 10B. However, the rib 90B may also be configured by a separate member from the right case 10B. Further, the rib 90B may not be perpendicular to the rotary shaft 82.

By the above configuration, when the left case 10A and the right case 10B are combined with each other upon assembling of the binding machine main body 10, an end face 90A2 of the rib 90A of the left case 10A and an end face 90B2 of the rib 90B of the right case 10B are contacted each other, except for parts corresponding to the support member 86, as shown in FIG. 2. Thereby, since the front space S1 of a front part of the binding machine main body 10, in which the twisting mechanism 7A is arranged, and the rear space S2 of a rear part of the binding machine main body 10, in which the drive mechanism 8A is arranged, are partitioned by the ribs 90A, 90B, it is possible to configure the rear space S2, into which a control unit 14A is provided, as a closed space. In the embodiment, the rear space S2 may be further divided into a rear upper space S2*a,* which is provided with the first guide part 50 in the binding machine main body 10 and is located above the axis L, and a rear lower space S2*b,* which is provided with the second guide part 51 and is located below the axis L.

Returning to FIG. 1, the reinforcing bar binding machine 1A includes a control unit 14A. The control unit 14A is configured to supply power to the twisting motor 80, a feeding motor (not shown) and the like, and to control the respective operations of the twisting motor 80 and the like. The control unit 14A is arranged in the rear upper space S2*a* at the rear of the ribs 90A, 90B configured to partition the inside of the binding machine main body 10 into the front and rear spaces. In other words, the control unit 14 is arranged in the rear space S2 different from the front space S1 in which the twisting mechanism 7A is arranged and is disposed at a position facing the handle part 11A with the twisting mechanism 7A being interposed therebetween in the binding machine main body 10.

Figure 3A:
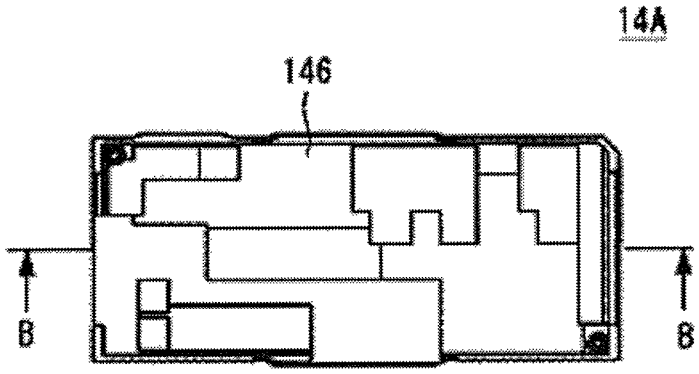
FIG. 3A is a rear view depicting an example of a control unit.
Figure 3B:
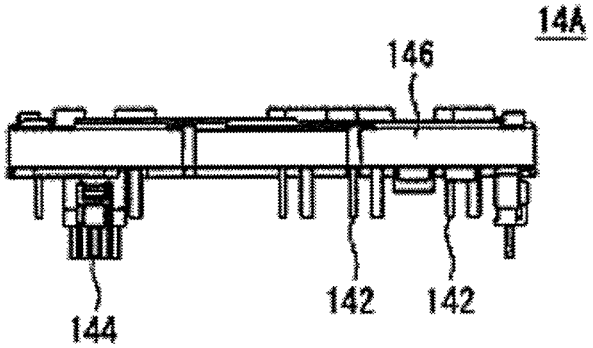
FIG. 3B is a front view thereof.
Figure 3C:
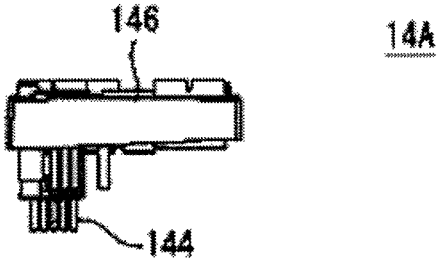
FIG. 3C is a side view thereof.
Figure 3D:
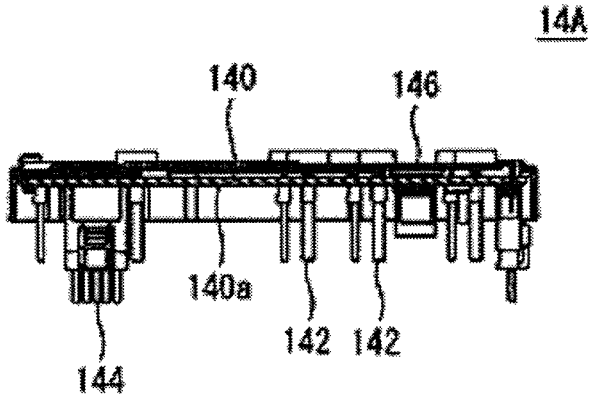
FIG. 3D is a sectional view thereof.

FIG. 3A is a rear view depicting an example of the control unit 14A, FIG. 3B is a front view thereof, FIG. 3C is a side view thereof, and FIG. 3D is a sectional view taken along a line B-B of FIG. 3A.

As shown in FIGS. 1 and 3A to 3D, the control unit 14A includes a main board (control board) 140, and a case 146 in which the main board 140 is accommodated.

The main board 140 is a board made of a resin material such as polyimide or the like, for example, and is mounted in the case 146 such that an active surface (component surface) 140*a,* on which an electronic component 144 and the like are mounted, faces below the drive mechanism 8A (refer to FIG. 1). A longitudinal direction of the main board 140 is a length from a front end position of the drive mechanism 8A to a position slightly ahead of an operation unit 16A. A width direction of the main board 140 is a length slightly shorter than a length of the binding machine main body 10 in the right and left direction.

The active surface 140*a* of the main board 140 is connected with one end portions of a plurality of wirings 142, and a plurality of electronic components 144 are mounted thereon. The other end portion of each wiring 142 and the other end portion of the wiring extending from each electronic component 144 are pulled out downward toward the twisting mechanism 7A, and are wired and connected to the twisting motor 80, the switch 13A and the like.

The case 146 has a size capable of accommodating therein the main board 140, for example, and is configured by a box member made of a resin material such as ABS or the like. The case 146 is assembled in the binding machine main body 10 such that an opening thereof faces the drive mechanism 8A (downward side).

Returning to FIG. 1, a rear part (a backside part of the other end side) of the binding machine main body 10 is provided with an operation unit 16A. The operation unit 16A includes a torque adjustment dial for adjusting fastening torque of the wire W, a switch for switching on and off states of a power supply of the reinforcing bar binding machine 1A, and an LED configured to be lighted based on the on and off states of the switch or the like. The operation unit 16A is connected to the control unit 14A via a wiring (not shown). In the embodiment, the wiring connecting the operation unit 16A and the control unit 14A each other is laid in the rear space S2 of the binding machine main body 10 partitioned into the front and rear spaces by the ribs 90A, 90B.

[Example of Operation of Reinforcing Bar Binding Machine 1A]

Subsequently, an example of the operation of the reinforcing bar binding machine 1A, which is performed when binding the reinforcing bars S with the wires W, is described with reference to FIGS. 1 and 4A to 4D. FIGS. 4A to 4D are views for illustrating an example of an operation of gripping and twisting the wire W.

Figure 4A:
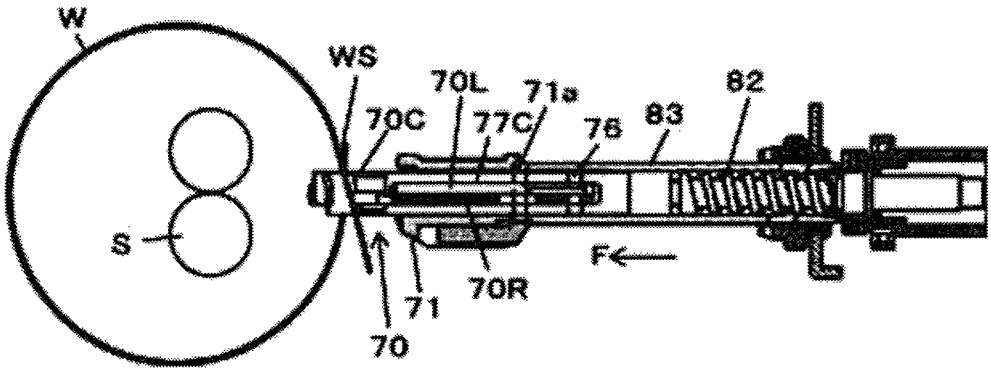
FIGS. 4A to 4D depict an example of an operation of the reinforcing bar binding machine when winding a wire on reinforcing bars and twisting the same.

As shown in FIGS. 1 and 4A, when two wires W are fed in the forward direction from the magazine 2A by the first feeding gear 30L and the second feeding gear 30R, the wires W pass between the fixed gripping member 70C and the second moveable gripping member 70R and pass through the guide groove 52 of the first guide part 50 of the curl guide unit 5A. Thereby, the wires W are curled to be wound around the reinforcing bars S.

The wires W delivered from the first guide part 50 are guided to the fixed guide part 54 with the movement being regulated by the moveable guide part 55 of the second guide part 51. The wires W guided to the fixed guide part 54 are prevented from moving along the radial direction of the loop Ru by the fixed guide part 54 and is guided between the fixed gripping member 70C and the first moveable gripping member 70L. Then, the tip ends of the wires W are butted to the length regulation part 74. Thereby, the wires W are wound in a loop shape around the reinforcing bars S.

Figure 4B:
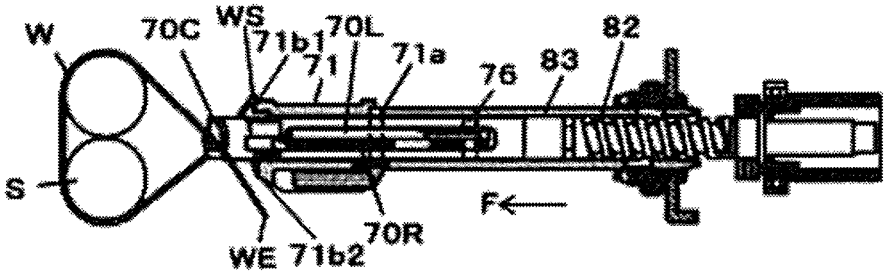

As shown in FIG. 4B, after stopping the feeding of the wires W, the twisting motor 80 is driven in the forward rotation direction, so that the twisting motor 80 moves the moveable member 83 in the arrow F direction, which is a forward direction. That is, a rotating operation of the moveable member 83 coupled to the rotation of the twisting motor 80 is regulated by the rotation regulation member 84, so that the rotation of the twisting motor 80 is converted into the linear movement. Thereby, the moveable member 83 is moved forward. In conjunction with the forward movement of the moveable member 83, the bending part 71 is moved forward, so that the first moveable gripping member 70L is moved in a direction of coming close to the fixed gripping member 70C by a rotating operation about a shaft 76, which is a support point. Thereby, one end portions WS of the wires W are gripped.

Also, the second moveable gripping member 70R is moved in the direction of coming close to the fixed gripping member 70C by a rotating operation about the shaft 76, which is a support point. The second moveable gripping member 70R is moved in the direction of coming close to the fixed gripping member 70C, so that the wires W are supported in the extension direction.

The forward moving operation of the moveable member 83 is transmitted to the retraction mechanism 53*a*, so that the guide pin 53 is retracted from the moving path of the wires W. After gripping one end portions WS of the wires W between the first moveable gripping member 70L and the fixed gripping member 70C, the feeding motor (not shown) is driven in the reverse rotation direction, so that the first feeding gear 30L is reversely rotated and the second feeding gear 30R is also reversely rotated in conjunction with the first feeding gear 30L. Thereby, the two wires W are pulled back toward the magazine 2A and are fed in the reverse direction. During the operation of feeding the wires W in the reverse direction, the wires W are wound on the reinforcing bars S with being closely contacted thereto.

After winding the wires W on the reinforcing bars S and stopping the feeding of the wires W, the twisting motor 80 is driven in the forward rotation direction, so that the moveable member 83 is moved forward. The forward moving operation of the moveable member 83 is transmitted to the cutting unit 6A by the transmission mechanism 62, so that the other end portions WE of the wires W gripped with the second moveable gripping member 70R and the fixed gripping member 70C are cut by the operation of the rotary blade part 61.

As shown in FIG. 4B, after cutting the wires W, the moveable member 83 is further moved forward, so that the bending part 71 is moved forward integrally with the moveable member 83.

Figure 4C:
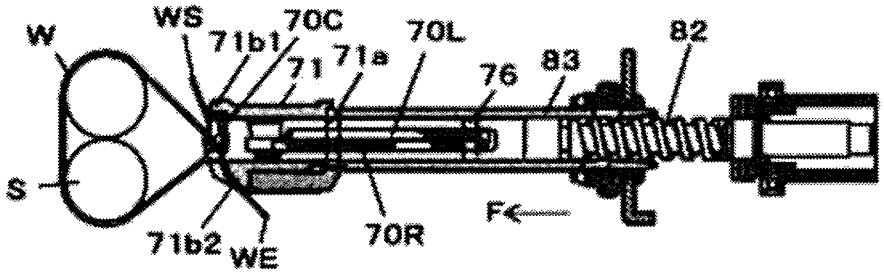

As shown in FIG. 4C, the bending part 71 is moved in the forward direction denoted with the arrow F by a predetermined distance, so that one end portions WS of the wires W gripped with the fixed gripping member 70C and the first moveable gripping member 70L are pressed toward the reinforcing bars S by a bending portion 71*b*1 and are thus bent toward the reinforcing bars S at the gripping position, which is a support point. Also, the bending part 71 is further moved forward, so that an opening and closing pin 71*a* is moved in an opening and closing guide hole 77R. Thereby, a gap in which one end portions WE of the wires W are fed is formed between the second moveable gripping member 70R and the fixed gripping member 70C.

Also, the bending part 71 is moved in the forward direction denoted with the arrow F by a predetermined distance, so that the other end portions WE of the wires W gripped with the fixed gripping member 70C and the second moveable gripping member 70R are pressed toward the reinforcing bars S by a bending portion 71*b*2 and are thus bent toward the reinforcing bars S at the gripping position, which is a support point.

Figure 4D:
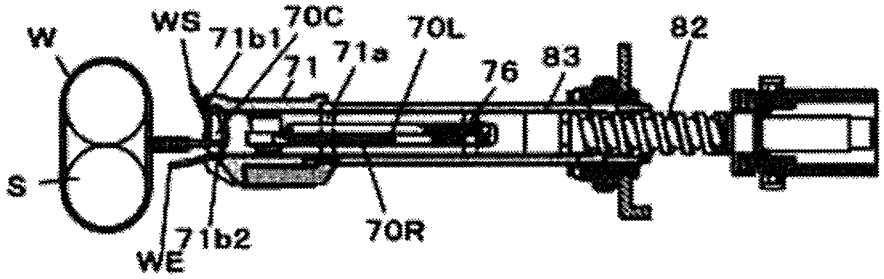

As shown in FIG. 4D, after bending the end portions of the wires W toward the reinforcing bars S, the twisting motor 80 is further driven in the forward rotation direction, so that the twisting motor 80 further moves the moveable member 83 in the forward direction denoted with the arrow F. The moveable member 83 is moved to a predetermined position in the arrow F direction, so that the moveable member 83 is disengaged from the rotation regulation member 84 and the rotation regulation state of the moveable member 83 by the rotation regulation member 84 is released. Thereby, the twisting motor 80 is further driven in the forward rotation direction, so that the gripping part 70 gripping the wires W is rotated and twists the wires W. The gripping part 70 is urged backward by a spring (not shown), so that it twists the wires W while applying tension thereto. Therefore, the wires W are not loosened, and the reinforcing bars S are bound with the wires W.

As described above, according to the embodiment, the ribs 90A, 90B are provided between the twisting mechanism 7A and the drive mechanism 8A, and the inside of the binding machine main body 10 is partitioned into the front space S1 and the rear space S2 in the front and back direction by the ribs 90A, 90B. Thereby, it is possible to shield iron powders and chips of the wires W, which are generated at the gripping part 70 and the like of the twisting mechanism 7A, by the ribs 90A, 90B, so that it is possible to prevent the iron powders and the like of the wires W from being introduced into the rear space S2 formed at the rear part of the binding machine main body 10. As a result, it is possible to prevent the iron powders and chips of the wires W from being attached and contacted to the wirings and the like of the control unit 14A, the operation unit 16A and the like, so that it is possible to securely avoid an operation defect and the like of the reinforcing bar binding machine 1A.

Also, in the embodiment, the main board 140 is arranged in the rear upper space S2*a,* and the wirings 142 and the like are pulled out from the lower side of the case 146 with the active surface 140*a* of the main board 140 facing toward the below drive mechanism 8A. Therefore, even though the iron powders and the like of the wires W are introduced into the rear upper space S2*a,* it is possible to make it difficult for the iron powders and the like to be attached to the main board 140 and the like.

Also, according to the embodiment, since it is possible to prevent the iron powders and the like from being attached to the control unit 14A by the ribs 90A, 90B, it is possible to reduce an amount of potting to be implemented on the active surface 140*a* of the main board 140 of the control unit 14A. Thereby, it is possible to save the cost of the control unit 14A and to lighten the control unit 14A.

Also, according to the embodiment, since the ribs 90A, 90B continuing from the upper end edge to the lower end edge of the binding machine main body 10 are provided, it is possible to enable the ribs 90A, 90B to function as a reinforcement member. Thereby, it is possible to improve the stiffness of the binding machine main body 10 with respect to the dropping of the binding machine main body 10 from the upper part (the control unit 14A)-side, so that it is possible to securely protect the main board 140 of the control unit 14A from a shock resulting from the dropping.

Also, according to the embodiment, since the operation unit 16A is provided at the rear part of the binding machine main body 10, the operator can easily check which torque dial is used for an operation, whether the power supply is on or off, whether an operation error has occurred, and the like upon the operation on a floor surface while avoiding the attachment of the iron powders and the like of the wires W.

Although the present disclosure has been described with the embodiment, the technical scope of the present disclosure is not limited to the embodiment. The embodiment can be variously changed or improved without departing from the gist of the present disclosure. Also, one or more requirements described in the embodiment may be omitted.

In the embodiment, the control unit 14A is arranged in the rear upper space S2*a*. However, the present disclosure is not limited thereto. For example, the control unit 14A may be arranged in the rear lower space S2*b* of the binding machine main body 10 or may be arranged on a side surface of the rear space S2 in the binding machine main body 10 as long as it is arranged at the rear side of the rib 90A, 90B (at the drive mechanism 8A-side) provided to the binding machine main body 10.

Also, in the embodiment, the reinforcing bars S are bound using the two wires W. However, the present disclosure is not limited thereto. For example, the present disclosure can be applied to a configuration where one wire W is used or three or more wires W are used.

1A: reinforcing bar binding machine
3A: wire feeding unit
4A: guide unit
5A: curl guide unit
7A: twisting mechanism (binding unit)
8A: drive mechanism (drive unit)
10: binding machine main body
10A: left case
10B: right case
11A: handle part
14A: control unit
16A: operation unit
82: rotary shaft (twisting shaft)
90A, 90B: rib (partition part)
140: main board (control board)
142: wiring
L: axis
S1: front space
S2: rear space
S2*a:* rear upper space
S2*b:* rear lower space
W: wire

The invention claimed is:

1. A binding machine comprising:

a wire feeding unit configured to feed a wire;

a curl guide configured to curl the wire fed by the wire feeding unit around an object to be bound;

a binding unit including a twisting shaft provided to be rotatable around a predetermined axis, a gripping part provided at one end side of the twisting shaft and a drive unit provided to the other end side of the twisting shaft, wherein the gripping part is configured to grip the wire curled by the curl guide and the twisting shaft is configured to twist the gripped wire so as to bind the object;

a control unit configured to control an operation of the drive unit;

an operation unit which is connected to the control unit by a wiring and which is configured to adjust fastening torque of the wire; and a binding machine main body configured to accommodate therein the binding unit, the control unit and the wiring, wherein when an inside of the binding machine main body is divided into two by a virtual plane perpendicular to or substantially perpendicular to the predetermined axis so as to be partitioned into a first space in which the gripping part is accommodated and a second space in which the drive unit is accommodated, the control unit and the wiring are arranged in the second space in which the drive unit is accommodated.

2. The binding machine according to claim 1, wherein the curl guide includes a first guide part configured to receive the wire from the wire feeding unit, and a second guide part configured to receive the wire from the first guide part, wherein the first guide part is provided at a position facing the second guide part with the predetermined axis being interposed therebetween, and wherein when a space in the binding machine main body which is provided with the first guide part and is located above the predetermined axis is set as an upper space and a space which is provided with the second guide part and is located below the predetermined axis is set as a lower space, the control unit is arranged in the upper space.

3. The binding machine according to claim 1, further comprising:

a handle part extending from the binding machine main body in a direction intersecting with the predetermined axis, wherein the control unit is arranged at a position facing the handle part with the binding unit being interposed therebetween in the binding machine main body.

4. The binding machine according to claim 1, wherein the binding machine main body includes a partition part configured to partition the first space and the second space.

5. The binding machine according to claim 4, wherein the partition part includes a flat plate member provided on an inner surface of the binding machine main body.

6. The binding machine according to claim 5, wherein the plate member is formed with a concave portion at a center thereof for fitting therein a support member which is provided between the binding unit and the drive unit.

7. The binding machine according to claim 5, wherein the plate member is formed integrally with the inner surface of the binding machine main body.

8. The binding machine according to claim 5, wherein the plate member is arranged to be perpendicular or substantially perpendicular to the twisting shaft.

9. The binding machine according to claim 1, wherein the twisting shaft is accommodated in the first space.

10. The binding machine according to claim 1, wherein the control unit includes a control board, and wherein the control board is arranged such that a component surface thereof faces the drive unit.

11. The binding machine according to claim 10, wherein a further wiring extends from an electronic component mounted on the component surface, and the further wiring extends toward the drive unit.

12. The binding machine according to claim 1, wherein at least a portion of the operation unit is exposed at a backside of the machine main body.

13. The binding machine according to claim 12, wherein the operation unit includes a dial for adjusting fastening torque.

14. The binding machine according to claim 1, wherein the operation unit includes a dial for adjusting fastening torque.

* * * * *